US010431192B2

(12) United States Patent
Rashad et al.

(10) Patent No.: US 10,431,192 B2
(45) Date of Patent: Oct. 1, 2019

(54) MUSIC PRODUCTION USING RECORDED HUMS AND TAPS

(71) Applicant: Humtap Inc., San Francisco, CA (US)

(72) Inventors: Tamer Rashad, Mountain View, CA (US); Andrea Cera, Vicenza (IT); Fredrik Wallberg, Berlin (DE)

(73) Assignee: Humtap Inc., San Francisco, CA (US)

( * ) Notice: Subject to any disclaimer, the term of this patent is extended or adjusted under 35 U.S.C. 154(b) by 0 days.

(21) Appl. No.: 14/932,911

(22) Filed: Nov. 4, 2015

(65) Prior Publication Data

US 2016/0125860 A1 May 5, 2016

Related U.S. Application Data

(63) Continuation-in-part of application No. 14/920,846, filed on Oct. 22, 2015, now abandoned, and a continuation-in-part of application No. 14/931,740, filed on Nov. 3, 2015, now abandoned.

(60) Provisional application No. 62/067,012, filed on Oct. 22, 2014, provisional application No. 62/074,542, filed on Nov. 3, 2014, provisional application No. 62/075,185, filed on Nov. 4, 2014.

(51) Int. Cl.
*G10H 1/00* (2006.01)

(52) U.S. Cl.
CPC ..... *G10H 1/0025* (2013.01); *G10H 2210/086* (2013.01); *G10H 2210/151* (2013.01); *G10H 2230/015* (2013.01)

(58) Field of Classification Search
CPC ..... G10H 1/0025; G10H 2210/105; G10H 2210/111; G10H 2210/151
USPC ..... 84/609
See application file for complete search history.

(56) References Cited

U.S. PATENT DOCUMENTS 4,463,650 A * 8/1984 Rupert ..... G10H 5/005 84/616
5,521,324 A 5/1996 Dannenberg et al.
5,874,686 A * 2/1999 Ghias ..... G06F 17/30743 84/609
6,737,572 B1 * 5/2004 Jameson ..... G10H 3/125 84/741
8,069,167 B2 11/2011 Gao et al.
8,222,507 B1 * 7/2012 Salazar ..... G10H 1/0008 84/602
8,453,058 B1 5/2013 Coccaro et al.
(Continued)

OTHER PUBLICATIONS

U.S. Appl. No. 14/932,888; Final Office Action dated Jan. 11, 2018.
(Continued)

*Primary Examiner* — Jeffrey Donels
(74) *Attorney, Agent, or Firm* — Polsinelli LLP

(57) ABSTRACT

Embodiments of the present invention provide for the composition of new music based on analysis of unprocessed audio, which may be in the form of melodic hums and rhythmic taps. As a result of this analysis—music information retrieval or MIR—musical features such as pitch and tempo are output. These musical features are then used by a composition engine to generate a new and socially co-created piece of content represented as an abstraction. This abstraction is then used by a production engine to produce audio files that may be played back, shared, or further manipulated.

19 Claims, 3 Drawing Sheets

(56) References Cited

U.S. PATENT DOCUMENTS

| | | | | |
|---|---|---|---|---|
| 8,868,411 | B2 * | 10/2014 | Cook | G10H 1/366 704/207 |
| 2003/0066414 | A1 * | 4/2003 | Jameson | G10H 3/125 84/741 |
| 2004/0078293 | A1 | 4/2004 | Iverson et al. | |
| 2005/0145099 | A1 | 7/2005 | Lengeling et al. | |
| 2006/0048633 | A1 | 3/2006 | Hoguchi | |
| 2007/0055508 | A1 | 3/2007 | Zhao et al. | |
| 2008/0264241 | A1 | 10/2008 | Lemons | |
| 2008/0302233 | A1 | 12/2008 | Ding et al. | |
| 2012/0167146 | A1 | 6/2012 | Incorvia | |
| 2012/0278021 | A1 | 11/2012 | Lin et al. | |
| 2013/0138428 | A1 | 5/2013 | Chandramoul et al. | |
| 2013/0151970 | A1 | 6/2013 | Achour | |
| 2013/0152767 | A1 | 6/2013 | Katz et al. | |
| 2013/0180385 | A1 * | 7/2013 | Hamilton | G10H 1/0016 84/603 |
| 2013/0204999 | A1 | 8/2013 | Lindberg | |
| 2014/0040119 | A1 | 2/2014 | Emmerson | |
| 2014/0226648 | A1 | 8/2014 | Xing et al. | |
| 2014/0280589 | A1 | 9/2014 | Atkinson | |
| 2014/0307878 | A1 | 10/2014 | Osborne et al. | |
| 2016/0066113 | A1 | 3/2016 | Elkhatib et al. | |
| 2016/0070702 | A1 | 3/2016 | Mao et al. | |
| 2016/0124969 | A1 | 5/2016 | Rashad | |
| 2016/0125078 | A1 | 5/2016 | Rashad | |
| 2016/0127456 | A1 | 5/2016 | Rashad | |
| 2016/0132594 | A1 | 5/2016 | Rashad | |
| 2016/0133241 | A1 | 5/2016 | Rashad | |
| 2016/0196812 | A1 | 7/2016 | Rashad | |

OTHER PUBLICATIONS

U.S. Appl. No. 14/932,888; Office Action dated Jun. 15, 2017.
U.S. Appl. No. 14/932,911; Office Action dated Mar. 10, 2016.
U.S. Appl. No. 14/932,881; Office Action dated Dec. 22, 2017.
U.S. Appl. No. 14/920,846; Office Action dated Nov. 16, 2017.
U.S. Appl. No. 14/931,740; Office Action dated Jan. 12, 2018.

* cited by examiner

300

MUSIC PRODUCTION USING RECORDED HUMS AND TAPS

CROSS-REFERENCE TO RELATED APPLICATIONS

The present application is a continuation-in-part and claims the priority benefit of U.S. patent application Ser. No. 14/920,846 filed Oct. 22, 2015, which claims the priority benefit of U.S. provisional application No. 62/067,012 filed Oct. 22, 2014; the present application is also a continuation-in-part and claims the priority benefit of U.S. patent application Ser. No. 14/931,740 filed Nov. 3, 2015, which claims the priority benefit of U.S. provisional application No. 62/074,542 filed Nov. 3, 2014; the present application claims the priority benefit of U.S. provisional application No. 62/075,185 filed Nov. 4, 2014. The disclosure of each of the aforementioned applications is incorporated herein by reference.

BACKGROUND OF THE INVENTION

Field of the Invention

The present invention generally relates to applying compositional grammar and rules to information retrieved or extracted from a musical selection. More specifically, the present invention relates to annotating feature data, applying instrumentation to the data, and rendering the same for playback, sharing, or further annotation.

Description of the Related Art

Music platforms that sell or handle label-owned or amateur-made songs are plentiful across the Internet, for example iTunes and Sound Cloud. Streaming solutions for label-owned and amateur-made content are likewise widely accessible, such as Pandora and Spotify. Music making sequencers or "virtual" musical instruments are also available from the Apple "App Store" and the Android "Marketplace."

Notwithstanding the presence of these solutions, the music industry is lacking an accessible way for users to express and share thoughts musically in radio or studio quality without knowledge of music making or music production. For example, an amateur musician may not have the extensive skills necessary to produce a studio or radio quality track notwithstanding that musician otherwise having the ability to create musical content. Similarly, someone interested in post-processing may not have the underlying talent to generate musical content to be processed. Nor is there an easy way for musicians to collaborate in real-time or near real-time without being physically present in the same studio.

There is a need in the art for identifying the compositional elements of a music selection—music information retrieval or "MIR." Through the use of machine learning and data science, hyper-customized user experiences could be created. For example, the aforementioned machine learning metrics may be applied to extracted music metrics to create new content. That content may be created without extensive musical or production training and without the need for expensive or complicated production equipment. Such a system could also allow for social co-creation of content in real-time or near real-time notwithstanding the physical proximity of contributors.

BRIEF SUMMARY OF THE CLAIMED INVENTION

An embodiment of the present invention provides for composing music based on unprocessed audio. Through the method, melodic hums and rhythmic taps are received. Information is retrieved from the melodic hums and rhythmic taps to generate extracted musical features which are then used to generate an abstraction layer. A piece of musical content is composed using the abstraction layer and then rendered in accordance with the abstraction.

DETAILED DESCRIPTION

Embodiments of the present invention provide for the composition of new music based on analysis of unprocessed audio, which may be in the form of melodic hums and rhythmic taps. As a result of this analysis—music information retrieval or MIR—musical features such as pitch and tempo are output. These musical features are then used by a composition engine to generate a new and socially co-created piece of content represented as an abstraction. This abstraction is then used by a production engine to produce audio files that may be played back, shared, or further manipulated.

Figure 1:
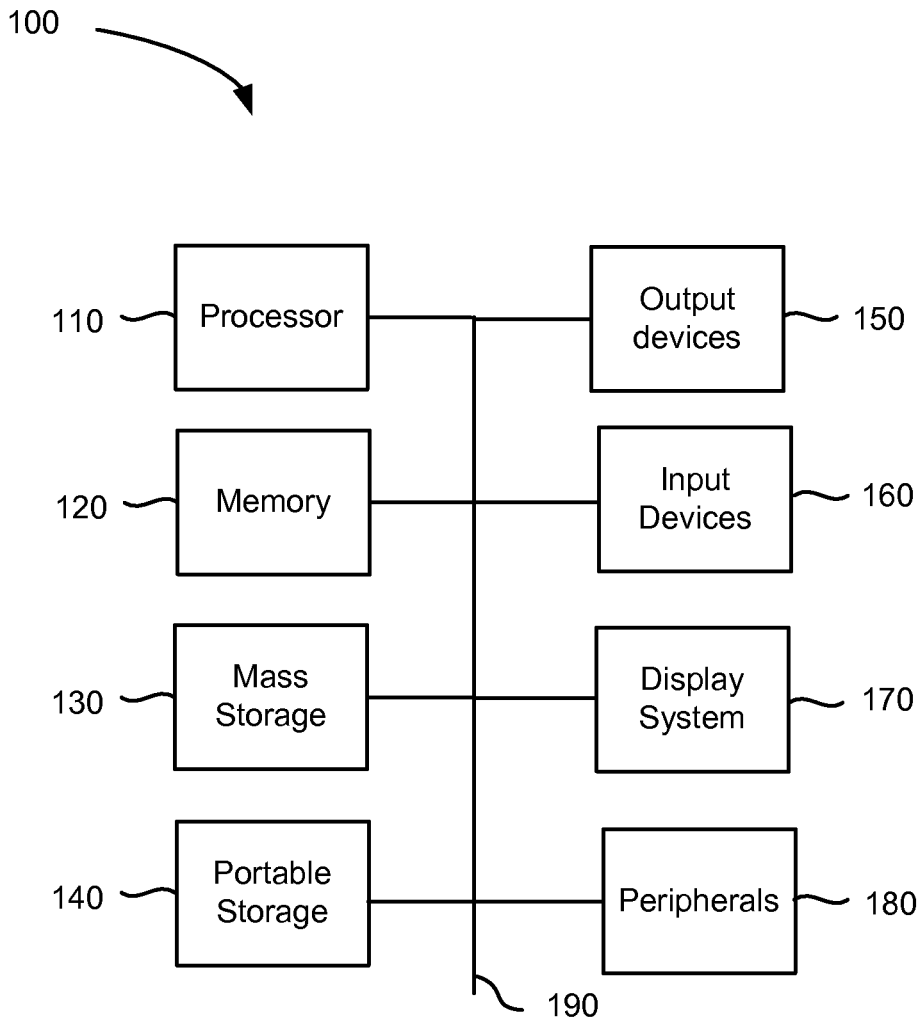
FIG. 1 illustrates an exemplary computing hardware device that may be used to perform music composition and production.

FIG. 1 illustrates an exemplary computing hardware device 100 that may be used to execute a composition engine and a production engine as further described herein. Hardware device 100 may be implemented as a client, a server, or an intermediate computing device. The hardware device 100 of FIG. 1 is exemplary. Hardware device 100 may be implemented with different combinations of components depending on particular system architecture or implementation needs.

For example, hardware device 100 may be utilized to implement musical information retrieval. Hardware device 100 might also be used for composition and production. Composition, production, and rendering may occur on a separate hardware device 100 or could be implemented as a part of a single device 100.

Hardware device 100 as illustrated in FIG. 1 includes one or more processors 110 and non-transitory main memory 120. Memory 120 stores instructions and data for execution by processor 110. Memory 120 can also store executable code when in operation, including code for effectuating composition, production, and rendering. Device 100 as shown in FIG. 1 also includes mass storage 130 (which is also non-transitory in nature) as well as non-transitory portable storage 140, and input and output devices 150 and 160. Device 100 also includes display 170 and well as peripherals 180.

The aforementioned components of FIG. 1 are illustrated as being connected via a single bus 190. The components of FIG. 1 may, however, be connected through any number of data transport means. For example, processor 110 and memory 120 may be connected via a local microprocessor bus. Mass storage 130, peripherals 180, portable storage 140, and display 170 may, in turn, be connected through one or more input/output (I/O) buses.

Mass storage 130 may be implemented as tape libraries, RAID systems, hard disk drives, solid-state drives, magnetic tape drives, optical disk drives, and magneto-optical disc drives. Mass storage 130 is non-volatile in nature such that it does not lose its contents should power be discontinued.

As noted above, mass storage 130 is non-transitory in nature although the data and information maintained in mass storage 130 may be received or transmitted utilizing various transitory methodologies. Information and data maintained in mass storage 130 may be utilized by processor 110 or generated as a result of a processing operation by processor 110. Mass storage 130 may store various software components necessary for implementing one or more embodiments of the present invention by loading various modules, instructions, or other data components into memory 120.

Portable storage 140 is inclusive of any non-volatile storage device that may be introduced to and removed from hardware device 100. Such introduction may occur through one or more communications ports, including but not limited to serial, USB, Fire Wire, Thunderbolt, or Lightning. While portable storage 140 serves a similar purpose as mass storage 130, mass storage device 130 is envisioned as being a permanent or near-permanent component of the device 100 and not intended for regular removal. Like mass storage device 130, portable storage device 140 may allow for the introduction of various modules, instructions, or other data components into memory 120.

Input devices 150 provide one or more portions of a user interface and are inclusive of keyboards, pointing devices such as a mouse, a trackball, stylus, or other directional control mechanism. Various virtual reality or augmented reality devices may likewise serve as input device 150. Input devices may be communicatively coupled to the hardware device 100 utilizing one or more the exemplary communications ports described above in the context of portable storage 140.

FIG. 1 also illustrates output devices 160, which are exemplified by speakers, printers, monitors, or other display devices such as projectors or augmented and/or virtual reality systems. Output devices 160 may be communicatively coupled to the hardware device 100 using one or more of the exemplary communications ports described in the context of portable storage 140 as well as input devices 150.

Display system 170 is any output device for presentation of information in visual or occasionally tactile form (e.g., for those with visual impairments). Display devices include but are not limited to plasma display panels (PDPs), liquid crystal displays (LCDs), and organic light-emitting diode displays (OLEDs). Other displays systems 170 may include surface conduction electron emitters (SEDs), laser TV, carbon nanotubes, quantum dot displays, and interferometric modulator displays (MODs). Display system 170 may likewise encompass virtual or augmented reality devices.

Peripherals 180 are inclusive of the universe of computer support devices that might otherwise add additional functionality to hardware device 100 and not otherwise specifically addressed above. For example, peripheral device 180 may include a modem, wireless router, or otherwise network interface controller. Other types of peripherals 180 might include webcams, image scanners, or microphones although the foregoing might in some instances be considered an input device.

Figure 2:
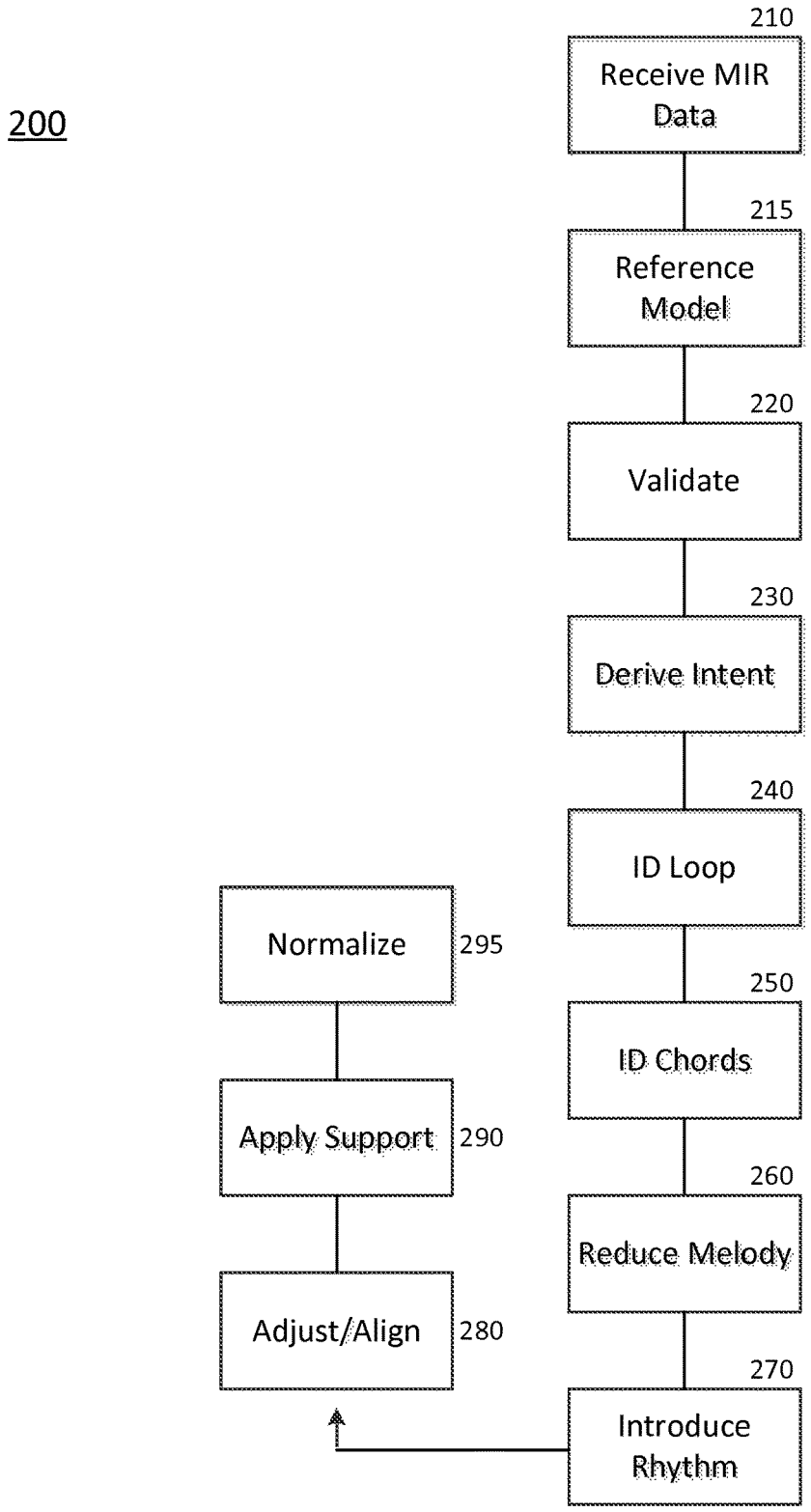
FIG. 2 illustrates a method for music composition.

Prior to undertaking the steps discussed in FIG. 2 with respect to music composition, a user of a mobile application or workstation application utters a hum into a microphone or other audio receiving device. From the uttered hum, information such as pitch, duration, velocity, volume, onsets and offsets, beat, and timbre are extracted. A similar retrieval of musical information occurs in the context of rhythmic taps whereby a variety of onsets are identified. Music information retrieval is discussed in greater detail in U.S. provisional application No. 62/075,176 entitled "Music Information Retrieval" and filed concurrently with the present application.

The aforementioned music retrieval operation involves receiving a melodic or rhythmic contribution at a microphone or other audio receiving device and transmitting that information to a computing device like hardware device 100 of FIG. 1. Transmission of the collected melodic information may occur over a system infrastructure like that described in U.S. provisional application Ser. No. 62/075,160 filed Nov. 4, 2014 and entitled "Musical Content Intelligence Infrastructure."

Upon receipt of the melodic musical contribution, hardware device 100 executes software to extract various elements of musical information from the melodic utterance. This information might include, but is not limited to, pitch, duration, velocity, volume, onsets and offsets, beat, and timbre. The extracted information is encoded into a symbolic layer.

Music information retrieval may operate in a similar fashion with respect to receipt of a tap or other rhythmic contribution at a microphone or audio receiving device operation in conjunction with a client application that provides for the transmission of information to a computing device like hardware device 100 of FIG. 1. Transmission of the rhythmic information may occur over the same system infrastructure discussed above. Upon receipt of the rhythmic musical contribution, hardware device 100 executes software to extract various musical data features. This information might include, but is not limited to high frequency content, spectral flux, and spectral difference. The extracted information is also encoded into the symbolic layer.

Extracted musical information is reflected as a tuple in the symbolic layer. Tuples are ordered lists of elements with an n-tuple representing a sequence of n elements with n being a non-negative integer—as used in relation to the semantic web. Tuples are usually written by listing elements within parenthesis and separate by commas (e.g., (2, 7, 4, 1, 7)).

By encoding extracted musical information into the symbolic layer, audio information may be flexibly manipulated as it transitions from the audible analog domain to the digital data domain and back as a newly composed, produced, and rendered piece of musical content. The symbolic layer is MIDI-like in nature in that MIDI (Musical Instrument Digital Interface) allows for electronic musical instruments and computing devices to communicate with one another by using event messages to specify notation, pitch, and velocity; control parameters corresponding to volume and vibrato; and clock signals that synchronize tempo.

The symbolic layer operates as sheet music. Through use of this symbolic layer, other software modules and processing routines, including those operating as a part of a composition engine, are able to utilize retrieved musical information for the purpose of applying compositional grammar rules. These rules operate to filter and adjust the musical contributions and corresponding features to deduce intent in a manner similar to natural language processing. An end result of the execution of the composition engine against the extracted feature data is a musical blueprint.

FIG. 2 illustrates a method 200 for music composition to generate the aforementioned blueprint. In step 210 of FIG. 2, the MIR data is retrieved. MIR data is retrieved from original musical contributions as discussed above and in U.S. provisional application No. 62/075,176 entitled "Music Information Retrieval." Raw MIR data or data as introduced into the abstraction layer may be maintained in a database that is a part of the aforementioned network infrastructure.

Prior to validation, at step 215, an arrangement model may be referenced to correlate the symbolic layer to a dictionary of functions for various musical styles. This may include various aspects of chord progression, instrumentation, eastern versus western tonality, and other information that will drive, constrain, or otherwise influence the building of the musical blueprint, especially during the derivation of intent operation at step 230. Various fundamentals of music theory are introduced during this operation.

Abstraction layer information is validated at step 220 to determine if the context includes within a reasonable range or otherwise meets basic musical assertions. For example, melodic data or rhythmic data could be presented as pure white noise and might generate some extractable features. That small subset of features would not, however, likely meet a basic definition of a musical contribution. If validation evidences that the symbolic layer is not indicative of musical content, then composition engine will not attempt to further process and develop a musical blueprint for the same. If the symbolic layer meets some basic assertions associated with musical content, then the composition operation continues.

At step 230, an effort is made to derive the intent of the musical contribution and, more specifically, its extracted musical features as represented in the symbolic layer. Deriving the intent of the music generally means to derive the intended melodies and rhythms from extracted features in the MIR data and, potentially, data in a user profile (e.g., previously indicated preferences or affirmatively derived preferences). To identify the intent and prepare the symbolic layer for further production, a quantization process takes raw data and intelligently maps the same into a hierarchical structure of music. The preparation step further involves identification of empirical points in the extracted features, for example, those having the most metrical weight.

At step 240, a seamless loop point is identified in the input file representing the symbolic layer. This loop point is used as a reference point for identifying the likes of chord progressions at step 250. The melody is, also at step 260, reduced to a fundamental skeletal melody based on the likes of harmonic tendencies and calculation of chord progressions. Skeletal melodies are representative of certain activity at, above, or below an emphasized point. The skeletal melody identification process is dynamic and based on runtime input.

Rhythmic patterns are introduced at step 270 on the basis of extracted feature data for 'taps' or rhythmic musical contributions. Adjustments are made at step 280 to align hums and taps (melody and rhythm), which may involve various timing information including but not limited to the aforementioned loop point. Step 290 involves the application of supporting chords and bass as might be appropriate in light of a particular musical style or genre.

Figure 3:
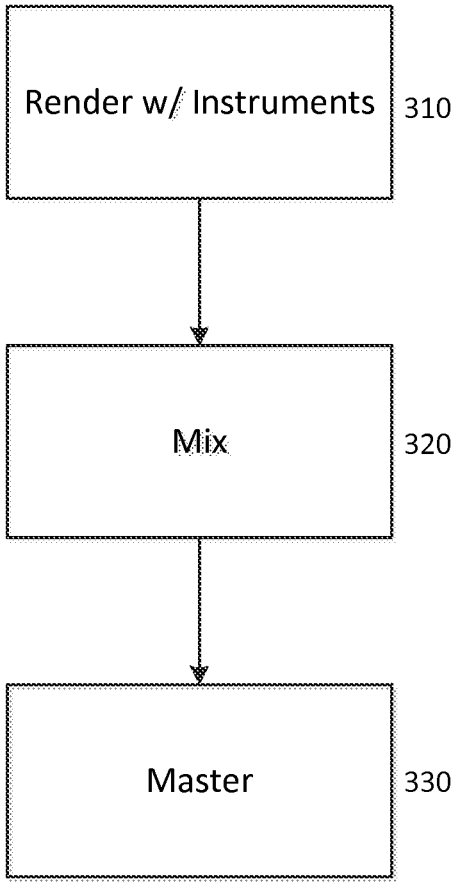
FIG. 3 illustrates a method for music production.

Corrections and normalization occur at step 295 before the completed blueprint is delivered for production and rendering as discussed in the context of FIG. 3. Music content may ultimately be passed as a MIDI file. For the purposes of musical information retrieval to a composition process, the abstract symbolic layer is passed versus the likes of a production file. Normalization ensures that various MIDI levels are correct before the data is passed for production.

FIG. 3 illustrates a method 300 for music production. Production work flow 300 utilizes the musical blueprint generated as a part of the work flow of FIG. 2. The method 300 of FIG. 3 effectuates a digital audio work station and digital production tools such that the audio may be rendered with instrumentation at step 310. The production process may also involve mixing, which may occur for any instrument and/or for any track at step 320. Step 330 invokes mastering in order to prepare and transfer the produced audio from a source to a final mix or data storage device like the database of the aforementioned network infrastructure.

The production process of FIG. 3 is meant to take place as quickly as possible. As such, the methodology of FIG. 3 may take various tracks, compositions, or other elements of output and processing them in parallel through the use of various rendering farms. It is envisioned that machine learning will ultimately identify particular user tastes and preferences as a part of the production process and that these nuances may subsequently be automatically or preemptively applied to the production process 300. It is also envisioned that a production engine that effectuates the method 300 of FIG. 3 will allow for third-party contributions and input.

The foregoing detailed description has been presented for purposes of illustration and description. The foregoing description is not intended to be exhaustive or to the present invention to the precise form disclosed. Many modifications and variations of the present invention are possible in light of the above description. The embodiments described were chosen in order to best explain the principles of the invention and its practical application to allow others of ordinary skill in the art to best make and use the same. The specific scope of the invention shall be limited by the claims appended hereto.

What is claimed is:

1. A method for producing music based on unprocessed audio, the method comprising:

receiving a musical blueprint input file reflective of melodic hums and rhythmic taps recorded in an audible analog domain at a microphone of a user device and converted to a digital domain;

identifying a melody in a symbolic layer associated with the musical blueprint input file, wherein the identified melody is relative to one or more identified points within the musical blueprint input file;

rendering music via instrumentation for one or more instruments based on the identified melody; and mixing the instrumentation for the one or more instruments, wherein a final mix track file is generated.

2. The method of claim 1, wherein the symbolic layer comprises one or more encoded tuples each representing extracted musical elements.

3. The method of claim 1, wherein the musical blueprint input file further comprises an abstraction layer.

4. The method of claim 1, further comprising correlating the symbolic layer to an arrangement model comprising a dictionary of musical style functions.

5. The method of claim 4, wherein correlating the symbolic layer to an arrangement model comprises applying at least one feature of the arrangement model, wherein the at least one feature is selected from chord progression, instrumentation, eastern tonality, and western tonality.

6. The method of claim 1, further comprising aligning the melodic hums and rhythmic taps relative to the identified points within the musical blueprint input file.

7. The method of claim 1, further comprising generating a map of the one or more identified points within the musical blueprint input file.

8. The method of claim 1, further comprising applying at least one correction or normalization of the musical blueprint input file prior to rendering.

9. The method of claim 1, further comprising transferring the final mix track file to a data storage device.

10. A system for producing music based on unprocessed audio, the method comprising:

a user device comprising a microphone that records melodic hums and rhythmic taps in an audible analog domain; and a server that converts the recorded melodic hums and rhythmic taps to a musical blueprint input file in a digital domain;

identifies a melody in a symbolic layer associated with the musical blueprint input file, wherein the identified melody is relative to one or more identified points within the musical blueprint input file;

renders music via instrumentation for one or more instruments based on the identified melody; and mixes the instrumentation for the one or more instruments, wherein a final mix track file is generated.

11. The system of claim 10, wherein the symbolic layer comprises one or more encoded tuples each representing extracted musical elements.

12. The system of claim 10, wherein the musical blueprint input file further comprises an abstraction layer.

13. The system of claim 10, wherein the server further correlates the symbolic layer to an arrangement model comprising a dictionary of musical style functions.

14. The system of claim 13, wherein the server correlates the symbolic layer to an arrangement model by applying at least one feature of the arrangement model, wherein the at least one feature is selected from chord progression, instrumentation, eastern tonality, and western tonality.

15. The system of claim 10, wherein the server further aligns the melodic hums and rhythmic taps relative to the identified points within the musical blueprint input file.

16. The system of claim 10, wherein the server further generates a map of the one or more identified points within the musical blueprint input file.

17. The system of claim 10, wherein the server further applies at least one correction or normalization of the musical blueprint input file prior to rendering.

18. The system of claim 10, wherein the server further transfers the final mix track file to a data storage device.

19. A non-transitory computer-readable storage medium, having embodied thereon a program executable by a processor to perform a method for producing music based on unprocessed audio, the method comprising:

receiving a musical blueprint input file reflective of melodic hums and rhythmic taps recorded in an audible analog domain at a microphone of a user device and converted to a digital domain;

identifying a melody in a symbolic layer associated with the musical blueprint input file, wherein the identified melody is relative to one or more identified points within the musical blueprint input file;

rendering music via instrumentation for one or more instruments based on the identified melody; and mixing the instrumentation for the one or more instruments, wherein a final mix track file is generated.

* * * * *